United States Patent [19]

Gater et al.

[11] 4,219,319

[45] Aug. 26, 1980

[54] MACHINES SUITABLE FOR USE IN THE MANUFACTURE OF CERAMIC WARE

[75] Inventors: Robert Gater; David L. J. Hancock, both of Stoke-on-Trent, United Kingdom

[73] Assignee: Service (Engineers) Limited, Stoke-on-Trent, England

[21] Appl. No.: 40,909

[22] Filed: May 21, 1979

[30] Foreign Application Priority Data

May 20, 1978 [GB] United Kingdom ..... 20970/78

[51] Int. Cl.[2] ..... B28B 11/22; B28B 21/92

[52] U.S. Cl. ..... 425/229; 425/383; 425/DIG. 120

[58] Field of Search ..... 425/225, 229, 383, DIG. 120; 264/60, 86, 138, 161, 162, 232, 233

[56] References Cited

U.S. PATENT DOCUMENTS

| | | | |
|---|---|---|---|
| 2,978,778 | 4/1961 | Strasser | 425/DIG. 120 |
| 3,040,409 | 6/1962 | Elliott | 425/DIG. 120 |
| 3,052,007 | 9/1962 | Dowley | 425/DIG. 120 |
| 3,074,138 | 1/1963 | Elliott | 425/DIG. 120 |

FOREIGN PATENT DOCUMENTS

| | | | |
|---|---|---|---|
| 1441093 | 6/1976 | United Kingdom | 425/383 |

*Primary Examiner*—W. E. Hoag

*Attorney, Agent, or Firm*—Scrivener, Parker, Scrivener and Clarke

[57] ABSTRACT

A machine suitable for use in removing seams from cup handles comprises means in the form of a turntable for carrying a plurality of sponges, viz. four, step-by-step successively through a series of operating stations at two of which smoothing operations are preformed on the handles and at two others of which the sponges are cleaned automatically to avoid such build up of clay material on them as will interfere with the satisfactory operation of the machine. Each sponge of the machine has a passage of suitably profiled cross-section through which each handle is caused to traverse first one way and then the other in the operation of the machine.

10 Claims, 4 Drawing Figures

MACHINES SUITABLE FOR USE IN THE MANUFACTURE OF CERAMIC WARE

At a cleaning station of the machine there is a hollow tube of similar profile to the cross-section of the passages in the sponges and with perforations in its wall, and means is actuated to cause the tube to travel to and fro in the passage of a sponge at that station and, during at least part of its traverse in the passage, water is expelled through the perforations in the tube. At a further station, means comprising a presser member for squeezing the sponges to remove excess water from them is provided, the presser member being brought down to bear upon a plate on the top of the sponge.

In each cycle of rotation of the turntable carrying the sponges, each sponge smooths a handle and is automatically washed with water and has excess water removed. Thus cleaning the sponges after each smoothing operation, the machine is able to maintain a regular uniform output of uniformly satisfactorily smooth handles.

It is customary in the ceramics industry, when manufacturing cups with handles, for the cup and the handle to be made separately and later joined together before firing of the clay takes place. Cup handles made separately from the cups to which they are to be attached usually have small ridges, referred to as seams, along both sides thereof which are caused by imperfectly joined mould-halves being used for moulding the handles. These seams would be unsightly if they appeared on a finished cup and so it is customary for them to be removed prior to the attaching of the handles to the cups.

The method used in removing seams from cup handles hitherto has usually involved an operator wiping both sides of the handle with, for example, a damp sponge. This method requires considerable skill in the operator to avoid distortion of the handle during wiping and occupies considerable time. It has been previously recognised that it is desirable to replace this wiping operation by a machine which can be operated without requiring great skill in the operator and which will rapidly remove seams from cup handles without causing distortion thereof.

A machine which has been introduced for the forgoing purpose is described in U.K. Pat. specification No. 1 441 093 and has a turntable which carries four sponges provided with profiled apertures of similar contour to the handles, but slightly narrower. Handles are pushed along the passages in the operation of the machine, first one way and then the other so that the inside and outside seams are removed and the handles smoothed symmetrically about the longitudinal central planes in which these seams lie. In using the machine, the operator removes the sponges to wash them after they have operated upon a few handles, squeezes excess moisture from them and puts them back. Not only is such interruption in the operation of the machine time consuming, but the maintenance of a steady output of satisfactorily smooth handles is unreliable because it depends upon the care and attention given by the operation.

It is one of the various objects of the present invention to provide an improved machine suitable for use in removing the seams of cup handles, in the operation of which uniformly satisfactorily smooth handles can be obtained at a regular uniform output.

A machine suitable for use in removing seams from cup handles comprising means for carrying a plurality of sponges step-by-step successively through a series of operating stations, each of the sponges having a passage of suitably profiled cross-section for removing the seams from the handles, means at a first station for pushing a handle one way along the passage of a sponge, means at a second station for pushing the handle along the passage the other way and for ejecting it from the sponge, means at a following station comprising a hollow tube of similar profile to the cross-section of the passages of the sponges with perforations in its wall, and means for causing the tube to traverse to a fro in the passage, means also being provided in the machine at this station for expelling water through the perforations of the tube during at least part of its traverse in each successive passage, and, at a further station, means comprising a presser member for squeezing the sponges to remove excess water, the machine being thus so arranged that each sponge is cleaned in a cycle of operation of the machine after removing the seam from a handle.

It is to be understood that the word "sponge" as used herein does not imply only natural sponges but includes synthetic substitutes. The properties desirable in the sponge are that it should be resilient and of small cell-size so as to ensure a smooth finish on the treated handles.

There now follows a detailed description, to be read with reference to the accompanying drawings, of a machine which illustrates the invention by way of example.

Figure 1:
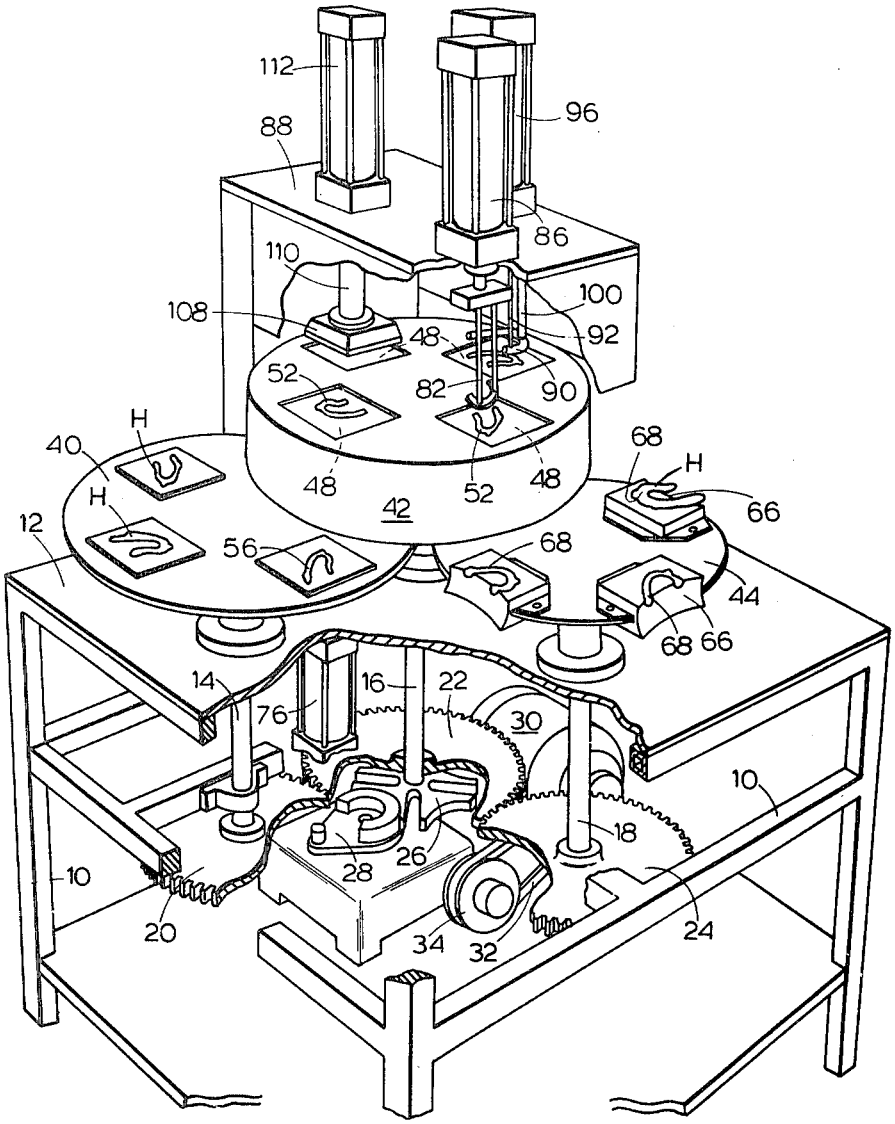
FIG. 1 is a view in perspective, with parts broken away, of the illustrative handle de-seaming machine.

The illustrative handle de-seaming machine comprises a frame 10 arranged to stand on the floor, and having a table top 12. Mounted in suitable bearings in the frame are three vertical shafts 14, 16 and 18 interconnected together by meshing gears 20, 22 and 24. The shaft 16 also carries a star wheel 26 of a geneva mechanism designed to effect step-by-step rotation of the shaft 16 through steps of 90°. The geneva mechanism also comprises a conventional driving member 28 arranged to be driven by an electric motor 30 through a belt 32 and pulley 34, which is mounted on an input shaft of a gear box 36.

Figure 2:
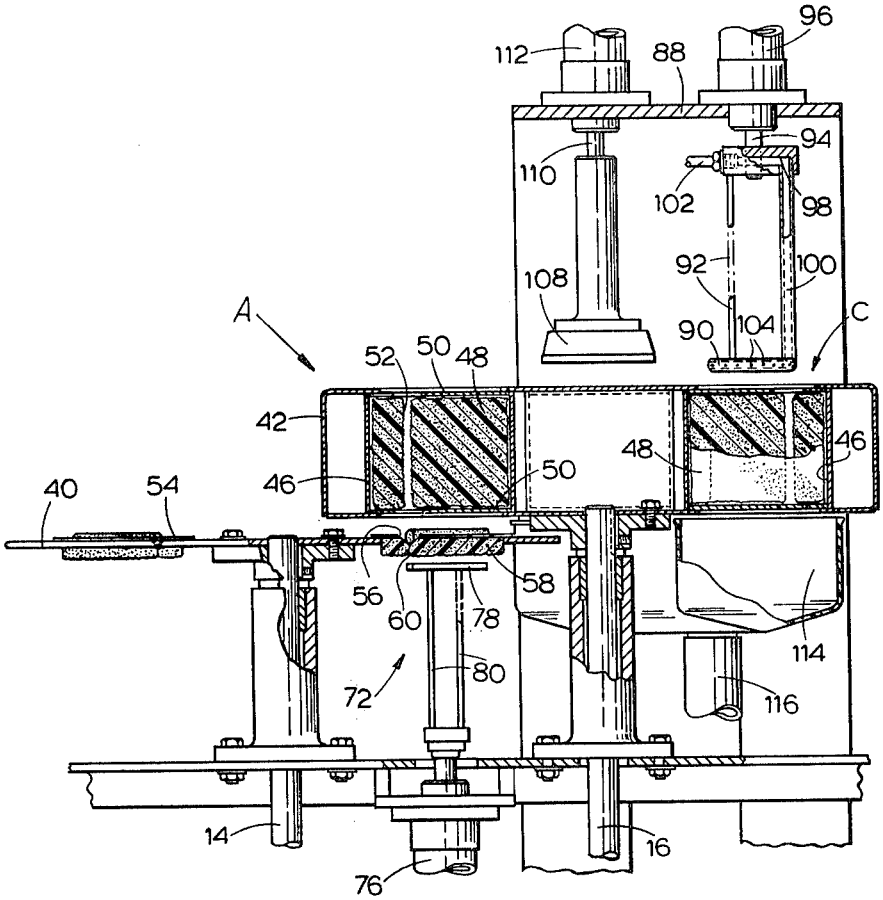
FIG. 2 is a view in vertical cross-section through part of the machine on the line indicated at II—II of FIG. 4.
Figure 3:
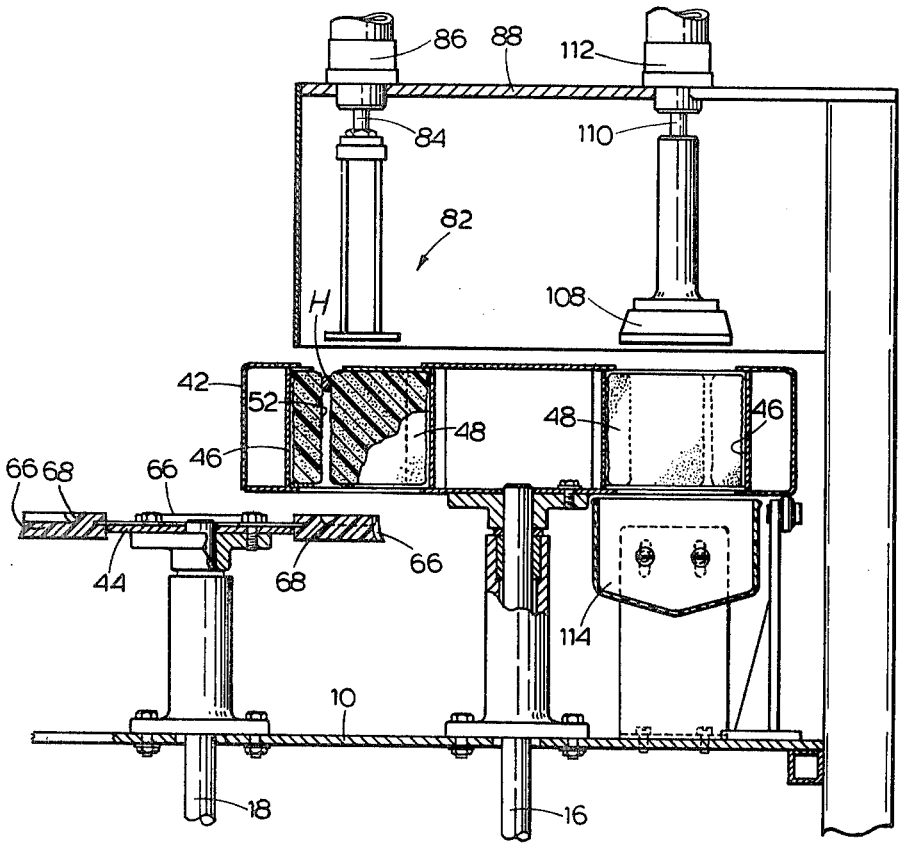
FIG. 3 is a view in vertical section similar to that of FIG. 2 but on the line III—III of FIG. 4 at right angles to the section of FIG. 2.

The shafts 14, 16 and 18 of the illustrative machine project up through the table top 12 and at their upper ends carry respectively three turntables 40, 42 and 44. The turntables 40 and 44 are substantially horizontal discs mounted at substantially the same height in side by side relationship to one another. The turntable 42 overlaps the turntables 40 and 44. The turntable 42 is of hollow construction with box like partitions, as shown in FIGS. 2 and 3. Each box like partition 46, of which there are four disposed at 90° about the axis of the shaft 16, contains a sponge with a passage through it which has a cross-section similar in profile to, but narrower than, handles H to be de-seamed. Metal plates 50 with slots in them of similar profile to the passages but rather wider are stuck to the upper and lower surfaces of the sponges. The passages 52 in the sponges are vertical.

Pressure on the upper one of the plates 50 causes the sponge 48 below it to be squeezed, as will be described hereinafter.

The turntable 40 of the illustrative machine has four handle supports (FIG. 2) located at 90° about the axis of the shaft 14, each handle support having a slot of similar profile to the handles H to be de-seamed, but narrower. As shown in FIG. 2, the support consists of a rectangular plate 54 with a profiled slot 56 in it substantially wider than a handle H, but on the underside of the plate is stuck a piece of sponge material with a slot 60 of the same profile as the handles but narrower, so that a handle can rest on it without falling through. Indeed, the slot is of a shape which flares open at the top and is nearly closed lower down. The plates 54 are readily replaceable by others for handles of different shapes.

The turntable 44 (FIG. 3) of the illustrative machine carries four dies 66 of plastic material disposed at 90° intervals around the axis of the shaft 18. Each die has a groove 68 in its upper surface of similar profile to the handles H, and two vertical bores 70 lead through the dies to the lower surface from the bottom of the grooves.

Figure 4:
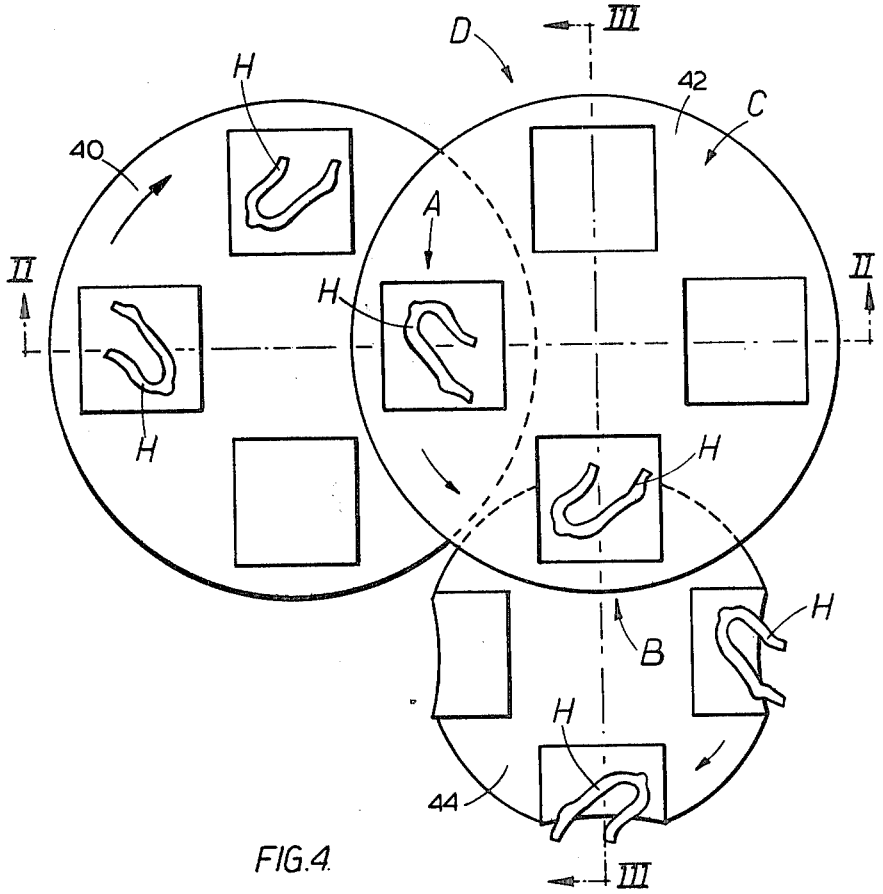
FIG. 4 is a diagrammatic plan view of three turntables of the illustrative machine.

The disposition of the turntables 40, 42 and 44, and of the geneva mechanism by which they are driven in steps of 90°, is such that at a first station A (FIG. 4) one of the sponges 58 of the handle supports on the turntable 40 as its slot 60 in alignment below the passage 52 in one of the sponges 48 on the turntable 42, and at the next station, B, to which the sponges pass from A as the turntable 42 moves anticlockwise in the operation of the machine, the passage 52 in the sponge 48 is in alignment with a handle-shaped groove 60° of a holder 66 of the turntable 44.

Below the turntable 40 (FIG. 2) at station A of the illustrative machine is a pusher 72 movable up and down by a piston 74 of a pneumatic cylinder 76. The pusher 72 comprises a handle-engaging bar 78 of similar size and profile to a handle H, supported in a horizontal plane by two rods 80 secured to the rod 74. The bar 78, on being raised, can thus pass up through the slot 60 of one of the sponges 58 on the turntable 40, lift a handle H off the sponge and push it most of the way up the passage 52 in one of the sponges 48 (see FIG. 3).

Above the turntable 74 (FIG. 3) at station B of the illustrative machine is a pusher 82 similar to the pusher 72 but mounted the other way up on a depending piston rod 84 of a pneumatic cylinder 86 supported by an overhanging bracket 88 of the frame 10. Thus, on a down stroke of the pusher 82, the handle H is pushed down through the passage 52 of the sponge 48 and ejected onto the holder 66 waiting below.

From station B, in the anticlockwise rotation of the turntable 42, the sponge 48 is carried to a washing station C (FIGS. 2 and 4), above which a hollow tube 90 of similar profile to the cross-section of the passages 52 in the sponges 48 is mounted in a horizontal plane at the lower end of two vertical rods 92 depending from a piston rod 94 of a pneumatic cylinder 96 mounted on the bracket 88. The piston rod 94 terminates at its lower end in a block 96 having a bore 98 in it which communicates by means of a vertical tube 100 with the tube 90. A flexible hose 102 is connected at one end to the block 96 in communication with the bore 98 and at its other end to a supply of water controlled by a valve (not shown). The wall of the tube 90 has perforations 104 in it. The arrangement is such that, while a sponge 48 which has just been used to smooth a handle H is at rest at station C of the illustrative machine, the tube 90 can be moved down the passage 52 and up again, and water can be expelled during all or part of its traverse of the passage through the perforations 104 under control of the aforementioned water supply valve.

From station C, the sponge 48 moves, in the operation of the illustrative machine, to station D above which is a presser member 108 mounted on a vertical piston rod 110 depending from a pneumatic cylinder 112 supported by the bracket 88. On descent, the presser member 108 engages the upper plate 50 and squeezes the sponge. An arcuate trough 114 (FIG. 2) extends below the table 42 to catch the water draining from stations C and D and the path of the sponge between them. The trough drains through a hose 116.

In the operation of the illustrative machine, the turntables 40, 42 and 44 rotate in synchronism step-by-step continuously. The cylinders 78, 86, 96 and 112 execute advance and return strokes in unison while the turntables are stationary, so that each handle H progresses from the slot 60 on which it rests on turntable 40 at station A to a position near the top of the passage 52 in a sponge 48, is then conveyed to station B where it is pushed down through the sponge and ejected onto the holder 66 (the handle having been now smoothed to remove its seam, its to and fro passage in the sponge ensuring retention of symmetry about the plane of the seam). From station B the handle can be conveyed to subsequent operations, for example the cutting of its attaching surfaces ready for attaching to a cup, while its orientation is retained by the groove 68 in which it rests.

Meanwhile, the sponge 48 in which the handle has been smoothed, passes to stations C and D to be washed and have excess moisture removed. The illustrative machine can thus continue to operate with long uninterrupted periods of output as little or no build up of clay material in the sponges occurs.

We claim:

1. A machine suitable for use in removing seams from cup handles comprising means for carrying a plurality of sponges step-by-step successively through a series of operating stations, each of the sponges having a passage of suitably profiled cross-section for removing the seams from the handles, means at a first station for pushing a handle one way along the passage of a sponge, means at a second station for pushing the handle along the passage the other way and for ejecting it from the sponge, means at a following station comprising a hollow tube of similar profile to the cross-section of the passages of the sponges with perforations in its wall, and means for causing the tube to traverse to and fro in the passage, means also being provided in the machine at this station for expelling water through the perforations of the tube during at least part of its traverse in each successive passage, and, at a further station, means comprising a presser member for squeezing the sponges to remove excess water, the machine being thus so arranged that each sponge is cleaned in a cycle of operation of the machine after removing the seam from a handle.

2. A machine according to claim 1 in which, when the machine is in use, the passages of the sponges are vertical, the machine also comprising conveyor means for presenting the handles to a position below and in alignment with the passage of a sponge at said first station, and conveyor means for receiving the handle ejected from the lower end of a passage of a sponge at said second station.

3. A machine according to claim 2 comprising three turntables interconnected for synchronized step-by-step movement, two of which are arranged side-by-side with the third overlapping them, a first one of the tables being provided with slots of similar profile to the cross-section of the passages in the sponges arranged to bring the handles one by one into alignment with the passage of the sponge at said first station, a pusher being provided to pass up through the slot and push the handle up into the sponge, and the second turntable being arranged to receive the ejected handles at said second station.

4. A machine according to claim 3, the second turntable of which has grooves of similar profile to the handles to maintain their orientation for a further operation.

5. A machine according to any one of claim 2 to 4 in which the means for causing the handles to traverse the passages in the sponges at the first and second stations are pushers of similar profile to the cross-section of the passages in the sponges.

6. A machine according to claim 5 comprising pneumatic cylinders for moving the pushers up and down and pneumatic cylinders for moving the hollow tube and presser member up and down.

7. A machine according to any one of claims 2 and 4 in which the hollow perforated tube is mounted above the path of the sponges, for movement downwardly and upwardly into and out of the passage of a sponge at that station.

8. A machine according to claim 7 in which the means for squeezing the sponges comprises a plunger mounted for vertical movement above the sponge at said further station so as to compress the sponge on its descent.

9. A machine according to claim 8 in which the spongecarrying turntable is a hollow structure with box-like partitions for the sponges.

10. A machine according to any one of claims 2 to 9 in which the sponges are mounted between upper and lower plates having slots of similar profile, but rather larger, than the passages in the sponges.

* * * * *